United States Patent [19]

Gemmill, Jr. et al.

[11] 4,440,655

[45] Apr. 3, 1984

[54] SULFUR-CONTAINING MANNICH BASES AND LUBRICANTS CONTAINING SAME

[75] Inventors: Robert M. Gemmill, Jr., Pitman; Andrew G. Horodysky, Cherry Hill, both of N.J.

[73] Assignee: Mobil Oil Corporation, New York, N.Y.

[21] Appl. No.: 398,534

[22] Filed: Jul. 15, 1982

Related U.S. Application Data

[63] Continuation-in-part of Ser. No. 280,736, Jul. 8, 1981, abandoned.

[51] Int. Cl.[3] ..... C10M 1/20; C10M 1/32; C10M 1/38

[52] U.S. Cl. ..... 252/47.5; 252/391; 564/368

[58] Field of Search ..... 44/73; 252/47.5, 391; 564/368

[56] References Cited

U.S. PATENT DOCUMENTS

| | | | |
|---|---|---|---|
| 3,416,903 | 12/1968 | Eckert et al. | 44/73 |
| 4,006,089 | 2/1977 | Chibnik | 44/73 X |
| 4,025,451 | 5/1977 | Plonsker et al. | 252/47.5 |
| 4,157,309 | 6/1979 | Wilgus et al. | 252/47.5 X |

FOREIGN PATENT DOCUMENTS

| | | | |
|---|---|---|---|
| 1518283 | 7/1978 | United Kingdom | 252/47.5 |

*Primary Examiner*—W. J. Shine
*Attorney, Agent, or Firm*—Alexander J. McKillop; Michael G. Gilman; Claude E. Setliff

[57] ABSTRACT

Reaction products from thiodephenol, aldehydes and amines are effective friction reducing additives in lubricants.

27 Claims, No Drawings

SULFUR-CONTAINING MANNICH BASES AND LUBRICANTS CONTAINING SAME

CROSS REFERENCE TO RELATED APPLICATIONS

This application is a continuation-in-part of copending application Ser. No. 280,736, filed July 8, 1981, now abandoned.

BACKGROUND OF THE INVENTION

1. Field of the Invention

This invention relates to Mannich base lubricant and liquid fuel additives and to compositions thereof with such lubricants and fuels.

2. Discussion of the Prior Art

A great deal of effort has been directed to providing a lubricant which will permit present-day automotive engines to be operated at a high level of efficiency over long periods of time. A difficulty arises because lubricating oils tend to deteriorate under the conditions of use, with attendant formation of sludge, lacquer, and resinous materials which adhere to the engine parts, thereby lowering the operating efficiency of the engine. To counteract the formation of these deposits, certain chemical additives have been found which, when added to lubricating oils, have the ability to keep the deposit-forming materials suspended in the oil, so that the engine is kept clean and in efficient operating condition for extended periods of time. These added agents are known in the art as detergents or dispersants.

One solution to the problem, as described in U.S. Pat. No. 3,368,972, involved the use of a conventional Mannich base made using a phenol containing a high molecular weight alkyl substituent. U.S. Pat. No. 2,459,114 also discloses the use of conventional Mannich bases, but made using short-chain alkyl-substituted hydroxyaromatics or a relatively high molecular weight straight chain chlorinated aliphatic hydrocarbon. British Pat. No. 1,518,283 teaches Mannich bases made using a thiodiphenol, but the phenols are bridged at the ortho position and the R groups are $C_1$ to $C_6$ alkyls. We have shown that phenols sulfurized at the ortho positions are not effective friction reducers in oils. U.S. Pat. No. 3,416,903 discloses similar Mannich bases made for use in middle distillate or jet fuel.

Another difficulty is that sliding or rubbing metal or other solid surfaces are subject to wear under conditions of extreme pressure. Wearing is particularly acute in modern engines in which high temperature and contact pressures are prevalent. Under such conditions, severe erosion of metal surfaces can take place even with present generation lubricants unless a load carrying or antiwear additive is present therein.

Friction is also a problem any time two surfaces are in sliding or rubbing contact. It is of especial significance in an internal combustion engine and related power train components, because loss of a substantial amount of the theoretical mileage possible from a gallon of fuel is traceable directly to friction. The Mannich bases of this invention unexpectedly are effective in decreasing this friction.

SUMMARY OF THE INVENTION

In accordance with the invention, there is provided a Mannich base reaction product made by reacting an aldehyde, one or more amines selected from (1) amines of the formula

NHZR'' wherein R'' is a $C_{10}$ to $C_{28}$ hydrocarbyl or hydroxyalkyl group and Z is hydrogen or R'', (2) cyclic amines having at least 6 carbon atoms in the ring, and (3) an alkylolamine of the formula:

HOR'''NHM wherein R'''is a $C_2$–$C_6$ alkyl group and M is hydrogen or —R'''OH (4) and mixtures thereof and one or more of a thiodiphenol of the formula

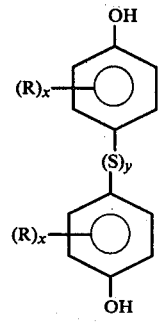

wherein R is a $C_1$–$C_{30}$ hydrocarbyl group, which may be an alkyl, alkenyl, aryl, alkaryl or aralkyl group, x is 0 to 2 and y is 1 to 3.

The aryl group can be one having from 6 to 14 carbon atoms, i.e. phenyl, naphthyl or anthryl. It will be understood that when x is 0, R is hydrogen. It will be further understood that R must not be in a position to block the Mannich reaction.

The invention also provides lubricant and liquid fuel compositions containing an anticorrosion or antifriction amount of same.

DESCRIPTION OF SPECIFIC EMBODIMENTS

New and useful products effective as friction reducers when added to lubricants are made by reacting a phenol of the formula

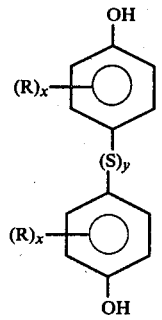

wherein R, x and y are as already defined with an aldehyde and an amine.

Representative thiodiphenols that may be used are thiodiphenol, dithiodiphenol and trithiodiphenol.

Aldehydes contemplated by the present invention are the aliphatic aldehydes, typified by formaldehyde or paraformaldehyde, acetaldehyde, and aldol(-hydroxy butyraldehyde); aromatic aldehydes, such as benzaldehyde and heterocyclic aldehydes, such as furfural. The aldehyde may contain a substituent group such as hydroxyl, halogen, nitro and the like. In short, any substituent can be used which does not take a major part in the reaction. Preference, however, is given to the aliphatic aldehydes, formaldehyde being particularly preferred.

The amines and the mixtures thereof contemplated herein are preferably those which contain a primary or secondary amino group. It is contemplated that these preferred amines include saturated and unsaturated linear or branched aliphatic primary and secondary monoamines having at least one group containing 10 to 28 carbon atoms. Cyclic amines are also contemplated and include cyclohexylamine and dicyclohexylamine.

The thiophenols used in this invention were purchased from commercial sources. In general, if desired or necessary, they can be prepared by reaction of a sulfur halide, or of sulfur, with a phenol.

Reaction between phenol, amine and aldehyde is carried out at from about 80° to about 150° C. Reaction times are not critical, ranging from about 1 hour or less up to 8 or more hours, depending upon the particular reactants.

In carrying out the reaction, the reactants thiophenol, aldehyde and amine can be used in molar ratios of about 1.0:0.1–10:0.1–10, respectively.

While the preferred mode of synthesis involves a one-step reaction in which all reactants are placed together, other modes can be used. For example, phenol and amine can be reacted to yield an ammonium phenate, and this product is then reacted with an aldehyde. This mode is not favorable, since one tends to get methylene bridged polymers. A third possible scheme involves the reaction of amine and aldehyde to yield a Schiff base ($R''N{=}CH_2$), followed by reaction of the Schiff base with phenol to give the product. Results using this reaction are more favorable than the second scheme mentioned, and they appear to be similar to the first reaction.

The novel additives of the invention have been disclosed to be reaction products, not identifiable single compounds. While they are believed to be complex mixtures of all the possible products obtainable from any given reaction mixture, the products are believed to contain substantial or even predominant amounts of compounds as shown in the following illustrative reaction:

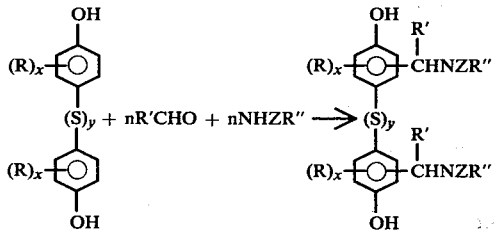

wherein R, x and y are as described above. R' may be a $C_1$–$C_6$ alkyl group, but is preferably hydrogen (from formaldehyde or paraformaldehyde), R'' is a $C_{10}$–$C_{28}$ hydrocarbyl or hydroxyalkyl group, Z is R'' or hydrogen and n is 2–4. Among the amines contemplated are cocoamine, oleylamine, decylamine, cyclohexylamine, cyclooctylamine, dodecylamine, tetradecylamine, hexadecylamine, octadecylamine, stearylamine, laurylamine, soyamine, and other secondary amines, ethanolamine, diethanolamines and other alkanolamines.

The additives can be used in a wide variety of systems at from about 0.1% to about 10% by weight preferably about 0.10% to about 4.0%.

Transmission fluids illustrate one system important to the present invention. These are blends of highly refined petroleum base oils combined with VI improvers, detergents, defoamants and special additives to provide controlled-friction or lubricity characteristics. Varied transmission design concepts have led to the need for fluids with markedly different frictional characteristics, so that a single fluid cannot satisfy all requirements. The fluids intended for use in passenger car and light-duty truck automatic transmissions are defined in the ASTM Research Report D-2:RR 1005 on "Automatic Transmission Fluid/Power Transmission Fluid Property and Performance Definitions". Specifications for low temperature and aircraft fluids are defined in U.S. Government Specification MIL-H-5606A. In addition, the oxidation and corrosion resistance of functional fluids such as hydraulic fluids can be improved by the adducts of the present invention.

Of particular significance, in accordance with the present invention, is the ability of the additives to improve a variety of properties of lubricants and liquid fuels. They include the wear resistance or friction qualities of lubricated parts and improved resistance to oxidation and corrosion of oleaginous materials such as lubricating media. These preferably comprise liquid oils, in the form of either a mineral oil, a synthetic oil or mixtures thereof, but also may be a grease in which any of the aforementioned oils are employed as a vehicle. In general, mineral oils, both paraffinic, naphthenic and mixtures thereof, employed as the lubricant, or grease vehicle, may be of any suitable lubricating viscosity range, as for example, from about 45 SUS at 100° F. to about 6000 SUS at 100° F., and preferably, from about 50 to about 250 SUS at 210° F. These oils may have viscosity indexes ranging to about 100 or higher. Viscosity indexes from about 70 to about 95 are preferred. The average molecular weight of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation. A wide variety of materials may be employed as thickening or gelling agents. These may include any of the conventional metal salts or soaps, which are dispersed in the lubricating vehicle in greaseforming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing the aforementioned improved grease in accordance with the present invention.

In instances where synthetic oils, or synthetic oils employed as the vehicle for the grease, are desired in preference to mineral oils, or in combination therewith, various compounds of this type may be successfully utilized. Typical synthetic vehicles include polyisobutylene, polybutenes, hydrogenated polydecenes, polypropylene glycol, polyethylene glycol, trimethylol propane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, phenoxy phenylethers.

The liquid fuels include hydrocarbon fuels such as gasoline, diesel fuel and the like, alkanol fuels, such as methanol and ethanol. "Fuels" also includes mixtures of hyhdrocarbon and alkanol fuels. Fuel compositions will contain from about 5 to about 500 pounds of additive per 1000 barrels of fuel, preferably about 20 to about 120 pounds per 1000 barrels.

It is to be understood that the compositions contemplated herein can also contain other materials. For example, other corrosion inhibitors, extreme pressure agents, antiwear agents, defoamants, detergents, dispersants, and the like can be used. These materials do not detract from the value of the compositions of this invention. Rather the materials serve to impart their customary properties to the particular compositions in which they are incorporated.

The following examples will illustrate the invention. They are illustrative only, and are not intended to limit the invention.

EXAMPLE 1

Di(mono-cocoamine) Mannich Base of 4,4'-Thiodiphenol

A 500 ml glass reactor fitted with a nitrogen inlet, stirrer, thermometer, Dean-Stark water trap and condenser was used for the reaction.

4,4'-Thiodiphenol (0.2 mole, 43.6 grams), paraformaldehyde (0.4 mole, 12.6 grams), cocoamine (0.4 mole, 81.6 grams) and 100 ml of toluene were charged to the reactor.

The reaction mixture was heated, using a nitrogen blanket and rapid stirring, to a maximum temperature of 113° C. (reflux) for one hour. A total of 7.9 ml of water (theory—7.8 ml) was collected. The toluene was removed by vacuum distillation.

The resulting product was a low-melting yellow wax melting just above room temperature. It is believed that the product contained a substantial amount of one or both of

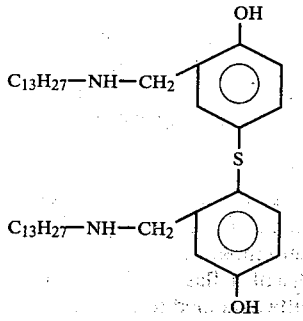

and

-continued

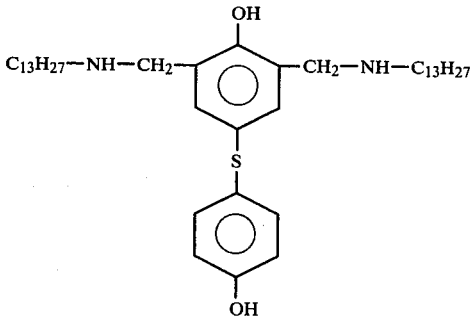

EXAMPLE 2

Di(mono-cocoamine) Mannich Base of 4,4'-Thiodiphenol

The general reaction procedure outlined in Example 1 was used as a guide. A 5 liter glass reactor fitted as in Example 1 was used.

4,4'-Thiodiphenol (1.6 moles, 349.2 grams), paraformaldehyde (3.2 moles, 101.0 grams), cocoamine (3.2 moles, 672.0 grams) and 300 ml of toluene were charged to the reactor. The reaction mixture was heated for 4 hours at a maximum temperature of 130° C. A total of 67.5 ml of water (theory—62.6 ml) was collected. The toluene was removed by vacuum distillation. The final product was a low melting yellow wax.

EXAMPLE 3

Tetra(mono-cocoamine) Mannich Base of 4,4'-Thiodiphenol

It is believed that the reaction product of this Example had a substantial amount of the compound of the following formula in it.

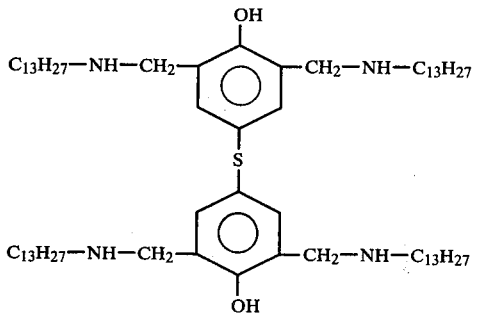

A 500 ml glass reactor as described in Example 1 was used.

4,4'-Thiodiphenol (0.1 mole, 21.8 grams), paraformaldehyde (0.4 mole, 12.6 grams), cocoamine (0.4 mole, 81.6 grams) and 100 ml of toluene were charged to the reactor.

The reaction mixture was heated for 2 hours at a maximum temperature of 120° C. A total of 7.9 ml of water (theory—7.8 ml) was collected. The toluene was removed by vacuum distillation. The final product was a yellow, fluid wax.

EXAMPLE 4

Di(dicocoamine), Di(diethanolamine) Mannich Base of 4,4'-Thiophenol

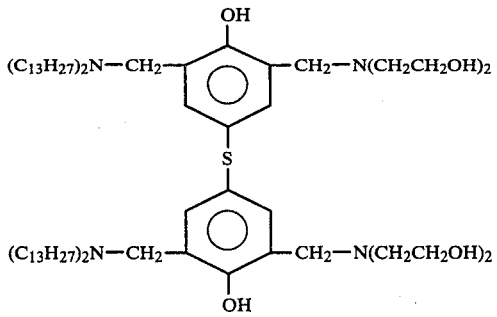

A 500 ml glass reactor as described in Example 1 was used.

4,4'-Thiodiphenol (0.1 mole, 21.8 grams), paraformaldehyde (0.4 mole, 12.6 grams), dicocoamine (0.2 mole, 78.0 grams), diethanolamine (0.2 mole, 21.0 grams) and 200 ml of toluene were charged to the reactor.

The reaction mixture was heated for 2 hours at a maximum temperature of 115° C. A total of 8.2 ml of water (theory—7.8 ml) was collected. The toluene was removed by vacuum distillation. The product was an amber, slightly hazy, fluid at room temperature.

The reaction product of this Example, it is believed, had therein a substantial amount of the above-shown compound, and was one of several possible isomeric structures.

EXAMPLE 5

Methylene Bridged Bis-Mannich Base of 4,4'-Thiodiphenol and Dicocoamine

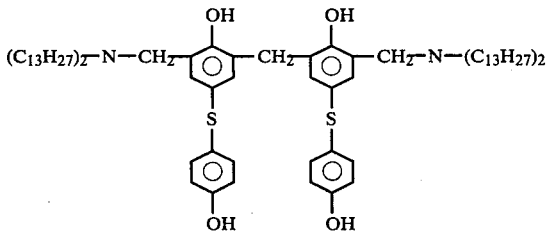

A 500 ml glass reactor as described in Example 1 was used.

4,4'-Thiodiphenol (0.2 mole, 43.6 grams), paraformaldehyde (0.3 mole, 9.45 grams), dicocoamine (0.2 mole, 78.0 grams) and 100 ml of toluene were charged to the reactor. The reaction mixture was heated for 2.5 hours at a maximum temperature of 120° C. A total of 5.6 ml of water (theory—5.8 ml) was collected. The toluene was removed by vacuum distillation. The product was a clear, orange, viscous fluid at room temperature.

It is believed that the above-shown compound represents one of the several possible isomeric structures and that the compound forms a substantial part of the reaction product of this Example.

EXAMPLE 6

Di(Oleylamine) Mannich Base of 4,4'-Thiodiphenol

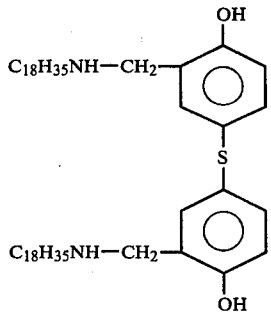

and

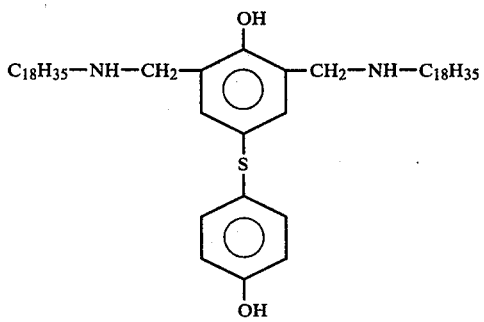

A 500 ml glass reactor as described in Example 1 was used.

4,4'-Thiodiphenol (0.2 mole, 43.6 grams), paraformaldehyde (0.4 mole, 12.6 grams), oleylamine (0.4 mole, 111.2 grams) and 100 ml of toluene were charged to the reactor.

The reaction mixture was heated for 2.5 hours at a maximum temperature of 120° C. A total of 8.0 ml of water (theory—7.8 ml) was collected. The toluene was removed by vacuum distillation. The product was a yellow, waxy fluid.

It is believed that the two compounds shown represent two of the possible configurations and that a substantial proportion of the reaction product is made up of one or both of them.

In general, the products of the Examples may be employed in any amount which is effective for imparting the desired degree of friction reduction or antiwear activity. In many applications, however, the adduct is effectively employed in amounts from about 0.1% to about 10% by weight, and preferably from about 1 to about 5% of the total weight of the composition.

EVALUATION OF THE COMPOUNDS

The compounds were evaluated in a low velocity friction apparatus (LVFA) in a fully formulated 5W-20 synthetic engine oil containing an additive package including antioxidant, dispersant and detergent. The test compound was 4% of the total weight of oil.

DESCRIPTION

The Low Velocity Friction Apparatus (LVFA) is used to measure the coefficient of friction of test lubricants under various loads, temperatures, and sliding speeds. The LVFA consists of a flat SAE 1020 steel surface (diam. 1.5 in.) which is attached to a drive shaft and rotated over a stationary, raised, narrow ringed SAE 1020 steel surface (area 0.08 in.$^2$). Both surfaces are submerged in the test lubricant. Friction between the steel surfaces is measured as a function of the sliding speed at a lubricant temperature of 250° F. The friction between the rubbing surfaces is measured using a torque arm-strain gauge system. The strain gauge output, which is calibrated to be equal to the coefficient of friction, is fed to the Y axis of an X-Y plotter. The speed signal from the tachometer-generator is fed to the X-axis. To minimize external friction, the piston is supported by an air bearing. The normal force loading the rubbing surfaces is regulated by air pressure on the bottom of the piston. The drive system consists of an infinitely variable-speed hydraulic transmission driven by a ½ HP electric motor. To vary the sliding speed, the output speed of the transmission is regulated by a lever-cam-motor arrangement.

PROCEDURE

The rubbing surfaces and 12–13 ml of test lubricants are placed on the LVFA. A 240 psi load is applied, and the sliding speed is maintained at 40 fpm at ambient temperature for a few minutes. Plots of coefficients of friction ($U_k$) vs. speed were taken at 240, 300, 400, and 500 psi. Freshly polished steel specimens are used for each run. The surface of the steel is parallel ground to 4 to 8 microinches. The results in Table 1 refer to percent reduction in coefficient of friction compared to the unmodified oil. That is, the formulation mentioned above was tested without the compound of this invention and this became the basis for comparison. The results were obtained at 250° F. and 500 psi.

Friction Reduction Evaluations
Low Velocity Friction Apparatus Bench Test (LVFA)

| | Additive Conc. Wt. % | % Reduction in the Coefficient of Friction at 5 Ft./Min. | 30 Ft./Min. |
|---|---|---|---|
| Test Oil | 0 | 0 | 0 |
| Example 1 | 4 | 23 | 22 |
| Example 2 | 4 | 18 | 26 |
| Example 3 | 4 | 17 | 20 |
| Example 4 | 4 | 14 | 13 |
| Example 5 | 4 | 12 | 10 |
| Example 6 | 4 | 16 | 21 |

The results clearly show the friction-reducing properties of these compositions relative to the base oil.

ANTIOXIDANT ABILITY

Several of the above Mannich bases were blended with 200" solvent paraffinic neutral lubricating oil and evaluated in a catalytic oxidation test. Samples of the test lubricants were placed in an oven at 325° F. The samples were in the presence of the following metals known to catalyze organic oxidation:

a. 15.6 sq. in. of sand blasted iron wire
b. 0.78 sq. in. of polished copper wire
c. 0.87 sq. in. of polished aluminum wire
d. 0.167 sq. in. of polished lead surface.

Dry air was passed through the test samples at a rate of about 5 liters per hour for 40 hours. The results demonstrate the antioxidant properties incorporated into these friction reducing compositions.

Catalytic Oxidation Test
325° F., 40 Hours

| | Additive Conc. Wt. % | Lead Loss mg | % Increase in Visc. of Oxidized Oil KV @ 100° C. | Final Neut. Number |
|---|---|---|---|---|
| Base Oil-200" Solvent Paraffinic Neutral Lubricating Oil | 0 | 0.4 | 27.0 | 2.21 |
| Example 1 | 1 | 0 | 11.7 | 2.53 |
| | 3 | 0 | 6.7 | 1.88 |
| Example 2 | 1 | 0 | 6.2 | 1.48 |
| | 3 | 0 | 10.1 | 1.38 |
| Example 3 | 1 | 0 | 9.5 | 2.21 |
| | 3 | +1.1 | 9.0 | 2.06 |

COPPER PASSIVATION ABILITY

Several of the ashless compositions were blended with 200" solvent paraffinic neutral lubricating oil and were tested for copper corrosivity using ASTM D130-80 at 250° F. for 3 hours and D130-80 at 210° F. for 6 hours.

Copper Strip Corrosion Tests

| | Additive Concentration in 200" SPN Wt. % | 3 Hours @ 250° F. D130-80 Rating | 6 Hours @ 210° F. D130-80 Rating |
|---|---|---|---|
| Example 1 | 1 | 1B | 1A |
| | 3 | 1A | 1A |
| Example 2 | 1 | 1A | 1A |
| | 3 | 1A | 1A |
| Example 3 | 1 | 1B | 1A |
| | 3 | 1B | 1A |

As is apparent from the claims which follow, it is essential that the linear or branched aliphatic amines have at least 10 carbon atoms and that the thiodiphenol have the sulfur bridge the phenols at the para positions. It has been shown, for example, that nonylphenol bridged with sulfur in the ortho positions are not effective friction reducers.

We claim:

1. A product of reaction made by reacting an aldehyde, at least one amine selected from (1) amines of the formula

NHZR"

wherein R" is a $C_{10}$ to $C_{28}$ hydrocarbyl or hydroxyalkyl group and Z is hydrogen or R", (2) cyclic amines having at least 6 carbon atoms in the ring, and (3) an alkylolamine of the formula:

HOR'''NHM wherein R''' is a $C_2$–$C_6$ alkyl group and M is hydrogen or —R'''OH, and at least one thiodiphenol of the formula:

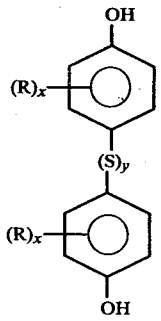

wherein R is a $C_1$–$C_{30}$ hydrocarbyl group, x is 0 to 2 and y is 1 to 3, the reaction being carried out at from about 80° C. to about 150° C. and said thiodiphenol, aldehyde and amine are used in molar ratios of 1.0:0.1–10:0.1–10, respectively.

2. The product of claim 1 wherein the aldehyde is an aliphatic, aromatic or heterocyclic aldehyde.

3. The product of claim 1 or 2 wherein the amine or mixture of amines is selected from a group of saturated or unsaturated aliphatic amines having at least one group containing 10 to 28 carbon atoms.

4. The product of claim 3 wherein the amine is decylamine, dodecylamine, tetradecylamine, hexadecylamine, octadecylamine, cyclohexylamine, cyclooctylamine, cocoamine, oleylamine, stearylamine, laurylamine, soyamine, ethanolamine, diethanolamine or mixtures thereof.

5. The product of claim 3 wherein the aldehyde is an aliphatic aldehyde.

6. The product of claim 5 wherein the aldehyde is formaldehyde or paraformaldehyde.

7. The product of claim 1 wherein the reactants are 4,4'-thiodiphenol, cocoamine and paraformaldehyde, present in a respective molar ratio of 1:2:2.

8. The product of claim 1 wherein the reactants are 4,4'-thiodiphenol, cocoamine and paraformaldehyde, present in a respective molar ratio of 1:4:4.

9. The product of claim 1 wherein the reactants are 4,4'-thiodiphenol, a 50-50 molar mixture of dicocoamine and diethanolamine, and paraformaldehyde, present in a respective molar ratio of 1:4:4.

10. The product of claim 1 wherein the reactants are 4,4'-thiodiphenol, oleylamine and paraformaldehyde, present in a respective molar ratio of 1:2:2.

11. The product of claim 1 wherein the reactants are 4,4'-thiodiphenol, dicocoamine and paraformaldehyde, present in a respective molar ratio of 1:1:1.5.

12. A lubricant composition comprising a major proportion of a lubricant and an anticorrosion or antifriction amount of the product of the reaction of claim 1.

13. The composition of claim 12 wherein in preparing said product the aldehyde is an aliphatic, aromatic or heterocyclic aldehyde.

14. The composition of claims 12 or 13 wherein in preparing said product the amine or mixture of amines is selected from a group of saturated or unsaturated aliphatic amines having at least one group containing 10 to 28 carbon atoms.

15. The composition of claim 14 wherein the amine is decylamine, dodecylamine, tetradecylamine, hexadecylamine, octadecylamine, cyclohexylamine, cyclooctylamine, cocoamine, oleylamine, stearylamine, laurylamine, soyamine, ethanolamine, diethanolamine or mixtures thereof.

16. The composition of claim 14 wherein the aldehyde is an aliphatic aldehyde.

17. The composition of claim 16 wherein the aldehyde is formaldehyde or paraformaldehyde.

18. The composition of claim 12 wherein in preparing the product the reactants are 4,4'-thiodiphenol, cocoamine and paraformaldehyde, present in a respective molar ratio of 1:2:2.

19. The composition of claim 12 wherein in preparing the product the reactants are 4,4'-thiodiphenol, cocoamine and paraformaldehyde, present in a respective molar ratio of 1:4:4.

20. The composition of claim 12 wherein in preparing the product the reactants are 4,4'-thiodiphenol, a 50-50 molar mixture of dicocoamine and diethanolamine, and paraformaldehyde, present in a respective molar ratio of 1:4:4.

21. The composition of claim 12 wherein in preparing the product the reactants are 4,4'-thiodiphenol, oleylamine and paraformaldehyde, present in a respective molar ratio of 1:2:2.

22. The composition of claim 12 wherein in preparing the product the reactants are 4,4'-thiodiphenol, dicocoamine and paraformaldehyde, present in a respective molar ratio of 1:1:1.5.

23. The composition of claim 12 wherein the lubricant is a lubricating oil.

24. The composition of claim 12 wherein the lubricant is a grease.

25. The composition of claim 23 wherein the oil is a mineral oil.

26. The composition of claim 23 wherein the oil is a synthetic oil.

27. The composition of claim 23 wherein the oil is a mixture of mineral and synthetic oils.

* * * * *

UNITED STATES PATENT AND TRADEMARK OFFICE

CERTIFICATE OF CORRECTION

PATENT NO. : 4,440,655

DATED : April 3, 1984

INVENTOR(S) : Robert M. Geimill, Jr. and Andrew G. Horodysky

It is certified that error appears in the above—identified patent and that said Letters Patent is hereby corrected as shown below:

In claim 5, "3" should be --2--.

In claim 16, "14" should be --13--.

Signed and Sealed this

*Thirtieth* Day of *October 1984*

[SEAL]

*Attest:*

GERALD J. MOSSINGHOFF

*Attesting Officer*

*Commissioner of Patents and Trademarks*